US007761031B2

(12) United States Patent
Martinez

(10) Patent No.: US 7,761,031 B2
(45) Date of Patent: Jul. 20, 2010

(54) METHODS OF INCREASING PRINTER CARTRIDGE COMPATIBILITY

(75) Inventor: Gerardo Martinez, Winnetka, CA (US)

(73) Assignee: Future Graphics Imaging Corporation, San Fernando, CA (US)

( * ) Notice: Subject to any disclaimer, the term of this patent is extended or adjusted under 35 U.S.C. 154(b) by 560 days.

(21) Appl. No.: 11/824,000

(22) Filed: Jun. 29, 2007

(65) Prior Publication Data

US 2009/0003873 A1 Jan. 1, 2009

(51) Int. Cl.
*G03G 15/00* (2006.01)

(52) U.S. Cl. ..... 399/109

(58) Field of Classification Search ..... 399/109, 399/111, 113

See application file for complete search history.

(56) References Cited

U.S. PATENT DOCUMENTS

| | | | | |
|---|---|---|---|---|
| 5,261,326 | A * | 11/1993 | Michlin | 101/483 |
| 6,654,577 | B1 * | 11/2003 | Hooper | 399/109 |
| 6,801,734 | B1 * | 10/2004 | Jones et al. | 399/109 |
| 6,904,248 | B2 * | 6/2005 | Daniels | 399/109 |
| 7,054,577 | B2 * | 5/2006 | Rogers et al. | 399/109 |
| 7,068,963 | B2 * | 6/2006 | Moore et al. | 399/109 |
| 7,477,864 | B2 | 1/2009 | Daniels | |
| 2007/0140732 | A1 | 6/2007 | Jones et al. | |
| 2007/0217814 | A1 | 9/2007 | Causey et al. | |
| 2008/0008494 | A1 * | 1/2008 | Martin et al. | 399/109 |
| 2008/0008495 | A1 * | 1/2008 | Martin et al. | 399/109 |
| 2009/0257774 | A1 * | 10/2009 | Rummler et al. | 399/109 |

FOREIGN PATENT DOCUMENTS

DE 202008012287 U1 * 12/2008

OTHER PUBLICATIONS

Product instructions from www.fgimaging.com, posted Apr. 21, 2005, FG Universal Waste Hopper Kit for HP1150/1200/1300.
Product instructions from www.fgimaging.com posted Oct. 20, 2005, HP2500/1500 to HP2550 Conversion End Caps.
Product instructions from www.fgimaging.com posted Oct. 26, 2007, HP P2015 Universal Waste Hopper Conversion Kit.
Product instructions from www.fgimaging.com posted Oct. 10, 2005, HP4250 End Cap.

* cited by examiner

*Primary Examiner*—Robert Beatty

(57) ABSTRACT

A method of modifying a printer cartridge, the printer cartridge being configured to be used with a first printer, the cartridge comprising a first toner hopper, a waste hopper connected to the first toner hopper, an end cap connected to the toner hopper, and a guide key connected to the end cap, the cartridge further comprising a bushing configured to surround a drum axle, the method comprising: modifying the guide key; modifying the bushing; providing a second printer; and using the printer cartridge with the second printer. A method of modifying a printer cartridge, the printer cartridge being configured to be used with a first printer, the cartridge comprising a first toner hopper and a waste hopper connected to the toner hopper, the method comprising: providing a second toner hopper, the second toner hopper being distinct from the first toner hopper; replacing the first toner hopper with the second toner hopper; providing a second printer; and using the cartridge with the second printer.

19 Claims, 10 Drawing Sheets

METHODS OF INCREASING PRINTER CARTRIDGE COMPATIBILITY

CROSS REFERENCES TO RELATED APPLICATIONS

None

FIELD OF INVENTION

The present invention relates to electrophotography, particularly methods and apparatus for manufacturing and remanufacturing toner cartridges.

BACKGROUND

Printer cartridges of fax machines, copiers, inkjet printers, and laser printers are often remanufactured. Printer cartridge re-manufacturers may first purchase or gather used printer cartridges that often have empty toner (and thus are commonly known in the industry as "empties"). The re-manufacturers may then clean the used printer cartridges, replace damaged parts, add toner, and replace worn parts.

Remanufactured cartridges that are compatible with certain printers may be in demand and present a business opportunity for re-manufacturers. However, empties for these printer cartridges in demand may be limited in supply. Re-manufacturers desire to find a way to increase the supply of empties of certain cartridges.

BRIEF DESCRIPTION OF THE PREFERRED EMBODIMENTS OF THE PRESENT INVENTION

A method of modifying a printer cartridge, the printer cartridge being configured to be used with a first printer, the printer cartridge comprising a first toner hopper, a waste hopper connected to the first toner hopper, an end cap connected to the toner hopper, and a guide key connected to the end cap, the cartridge further comprising a bushing configured to surround a drum axle, the method comprising: modifying the guide key; modifying the bushing; providing a second printer; and using the printer cartridge with the second printer.

A method of modifying a printer cartridge, the printer cartridge being configured to be used with a first printer, the cartridge comprising a first toner hopper and a waste hopper connected to the toner hopper, the method comprising: providing a second toner hopper, the second toner hopper being distinct from the first toner hopper; replacing the first toner hopper with the second toner hopper; providing a second printer; and using the cartridge with the second printer.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Also, it is to be understood that the phraseology and terminology employed herein are for the purpose of description and should not be regarded as limiting. The detailed description makes references to printer cartridges from Hewlett Packard Company of Palo Alto, Calif. It should be understood that the invention may be practiced with printer cartridges from various other manufacturers, which may or may not be original equipment manufacturers (OEMs). The references to printer cartridges from Hewlett Packard Company are for illustration only and should not be regarded as limiting.

The present invention includes various methods of converting a printer cartridge that is initially designed for use with a particular printer to a printer cartridge that may be used with a different printer or multiple printers. At least one embodiment of the present invention involves changing the toner hopper of the cartridge so that the cartridge may be used with a different printer. Another embodiment of the present invention involves modifying at least a portion of a guide key that is attached to an end cap of a cartridge and changing a drum axle bushing of the cartridge to convert the cartridge into one that may be used for multiple printers. Yet another embodiment of the present invention involves combining both previously described embodiments. To understand how the methods work, the structures of the various exemplary printer cartridges will now be explained.

Printer Cartridges for HP1160 Printers

Figure 1:
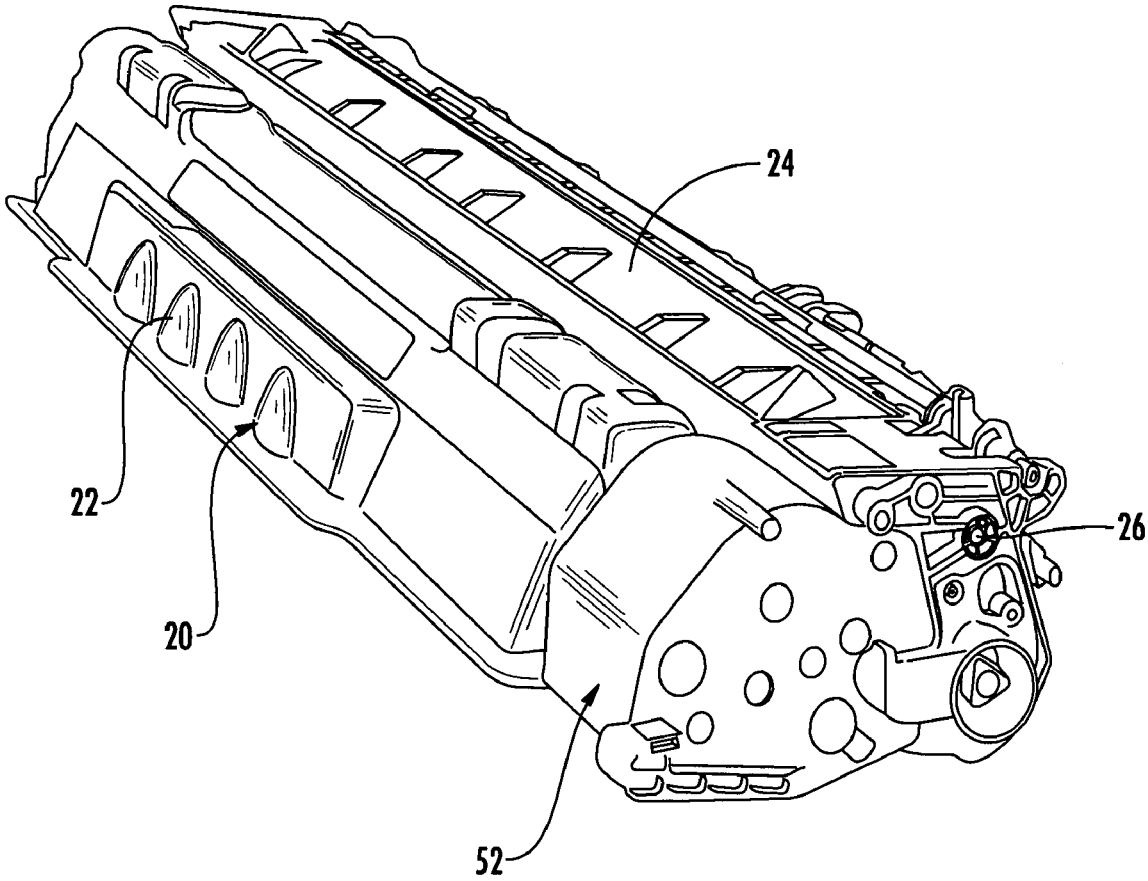
FIG. 1 (PRIOR ART)
FIG. 1 is substantially a perspective view of a first printer cartridge that is compatible with a first printer type.

As with typical printer cartridges, the printer cartridge 20 for an HP1160 printer includes a toner hopper 22, a waste hopper 24, and end caps 52 positioned on each side of the cartridge 20. The toner hopper 22 is where toner (not shown) is stored for use when printing. Excess toner (not shown) after printing is stored in the waste hopper 24. The toner hopper 22 and the waste hopper 24 are attached by cartridge pins 26 located on both sides of the cartridge (FIG. 1).

Printer Cartridges for HP1320 Printers

Figure 2:
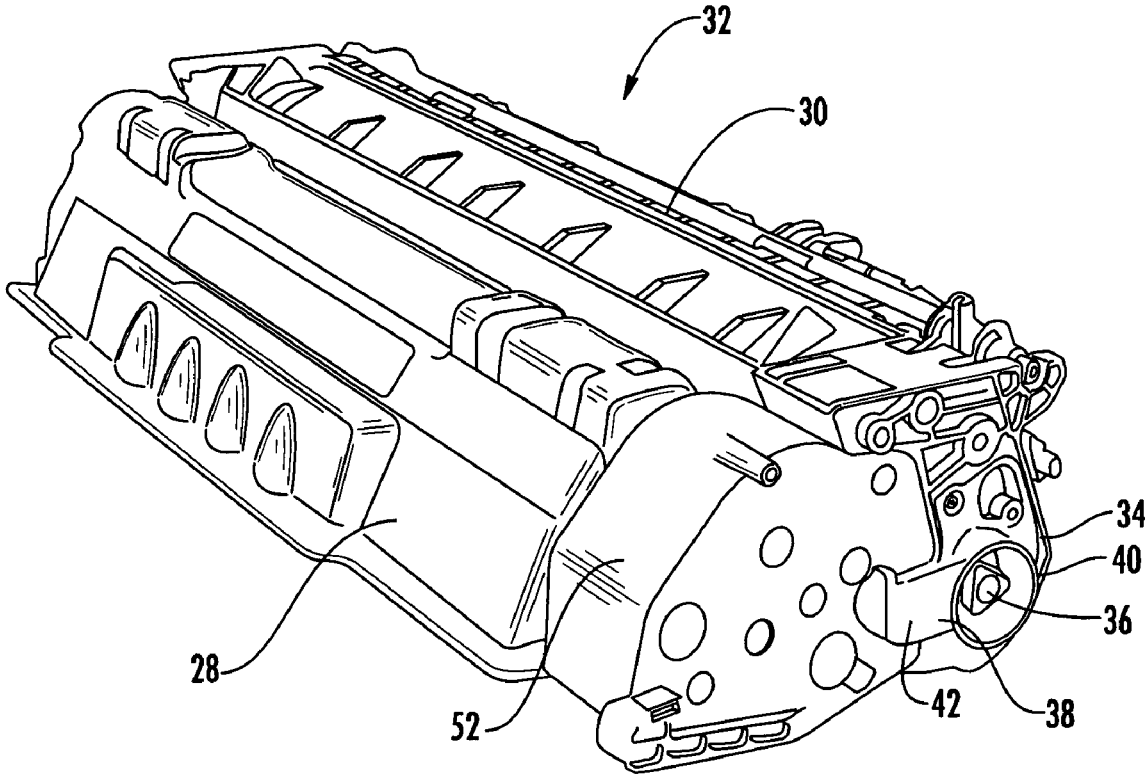
FIG. 2 (PRIOR ART)
FIG. 2 is substantially a perspective view of a second printer cartridge that is compatible with a second printer type.

The printer cartridge 32 for HP1320 printers also includes a toner hopper 28 and a waste hopper 30 (FIG. 2). The applicant has compared the printer cartridges for the HP1160 and HP1320 printers, and the applicant has observed that both cartridges have substantially the same waste hoppers 24,30 but different toner hoppers 22,28. The applicant has observed that the toner hopper 28 for the HP1320 printer 32 is bigger in size and toner capacity than the toner hopper 22 for the HP1160 printer cartridge 20. The applicant has further discovered that by changing the toner hopper 22 of the HP1160 printer cartridge 32 with a toner hopper of the same size and capacity as the toner hopper 28 of the HP1320 printer cartridge 20, the HP1160 printer cartridge 20 becomes usable with HP1320 printers.

First Embodiment of the Printer Cartridge Conversion Method

Figure 3:
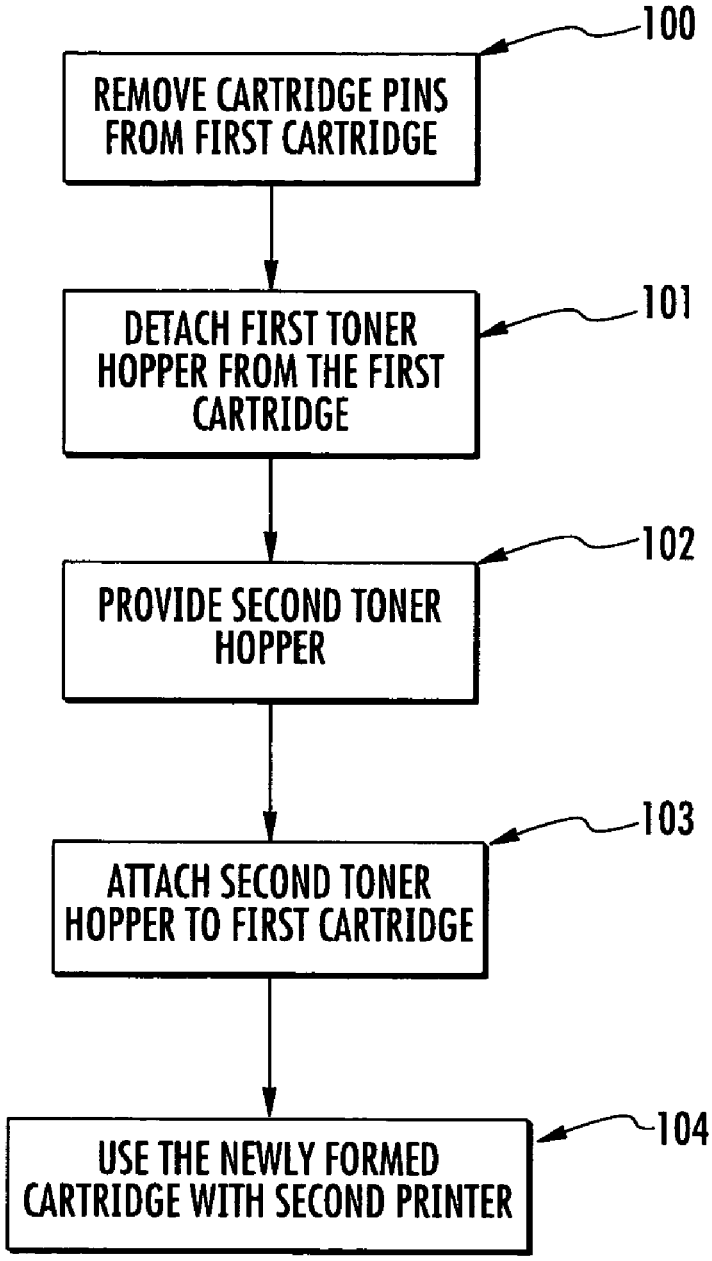
FIG. 3 is substantially a flowchart showing a first embodiment of the printer cartridge conversion method of the present invention.

Referring now to FIG. 3, to convert a printer cartridge that is initially designed to be used only for a single printer type (hereinafter a "first" printer type) to a cartridge that may be used with a different printer type (hereinafter a "second" printer type), the cartridge pins holding the toner hopper and waste hopper may be removed, such as pins 26 shown in FIG. 1 (step 100). The toner hopper may then be detached from the waste hopper (step 101).

Next, a larger toner hopper may be provided (step 102). In the example presented above, the larger toner hopper may come from a cartridge suitable for a second type of printer, such as the cartridge for the HP1320 printer. The larger toner hopper may not initially be suitable for the first printer type. The larger toner hopper may be from a used cartridge or may be a newly manufactured toner hopper. The larger toner hopper may then be installed to the cartridge from which the smaller toner hopper was previously removed (step 103). The newly formed cartridge may then be used for the second type of printers (step 104). In the example presented above, HP1160 cartridge is initially designed to be used only for an HP1160 printer. The HP1160 compatible cartridge was converted to the newly formed cartridge using the present invention, which may then be used for HP1320 printers. It can therefore be realized that certain embodiments of the present invention provide increased functionality and compatibility for certain printer cartridges.

Second Embodiment of the Printer Cartridge Conversion Method

The second embodiment of the printer cartridge conversion method is exemplified by the conversion of a cartridge for an HP1320 printer to a cartridge that may be used for an HP1320 printer, an HP2015 printer, or both. To understand the second embodiment of the present invention, the relevant components of the cartridges for HP1320 and HP2015 printers will now be explained.

HP1320 Printer Cartridges

Referring back to FIG. 2, cartridges 32 for the HP1320 printer include a waste bin 30, which is where a drum (not shown) is positioned. The drum (not shown) is attached to the sidewalls 34 of the waste bin via an axle 36. The axle 36 spans from the portion of the waste bin that is within the confines of the waste bin through the portion of the sidewall 34 that is opposite the confines of the waste bin (hereinafter "sidewall exterior"). The portion of the axle 36 that protrudes through the sidewall exterior is surrounded by a drum bushing 38, which includes a circular structure 40 surrounding the axle 36 and a bushing arm 42 attached to the circular structure 40.

Figure 4:
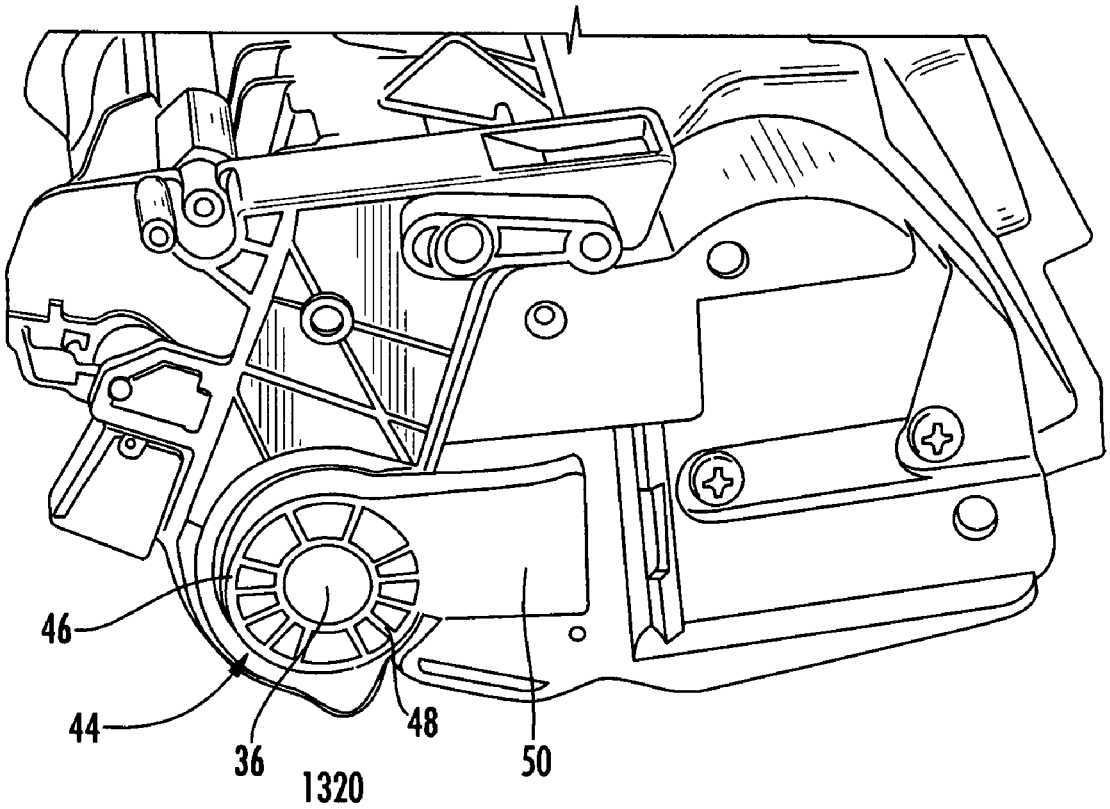
FIG. 4 (PRIOR ART)
FIG. 4 is substantially a front view of one side the first printer cartridge showing the drum bushing.
Figure 5:
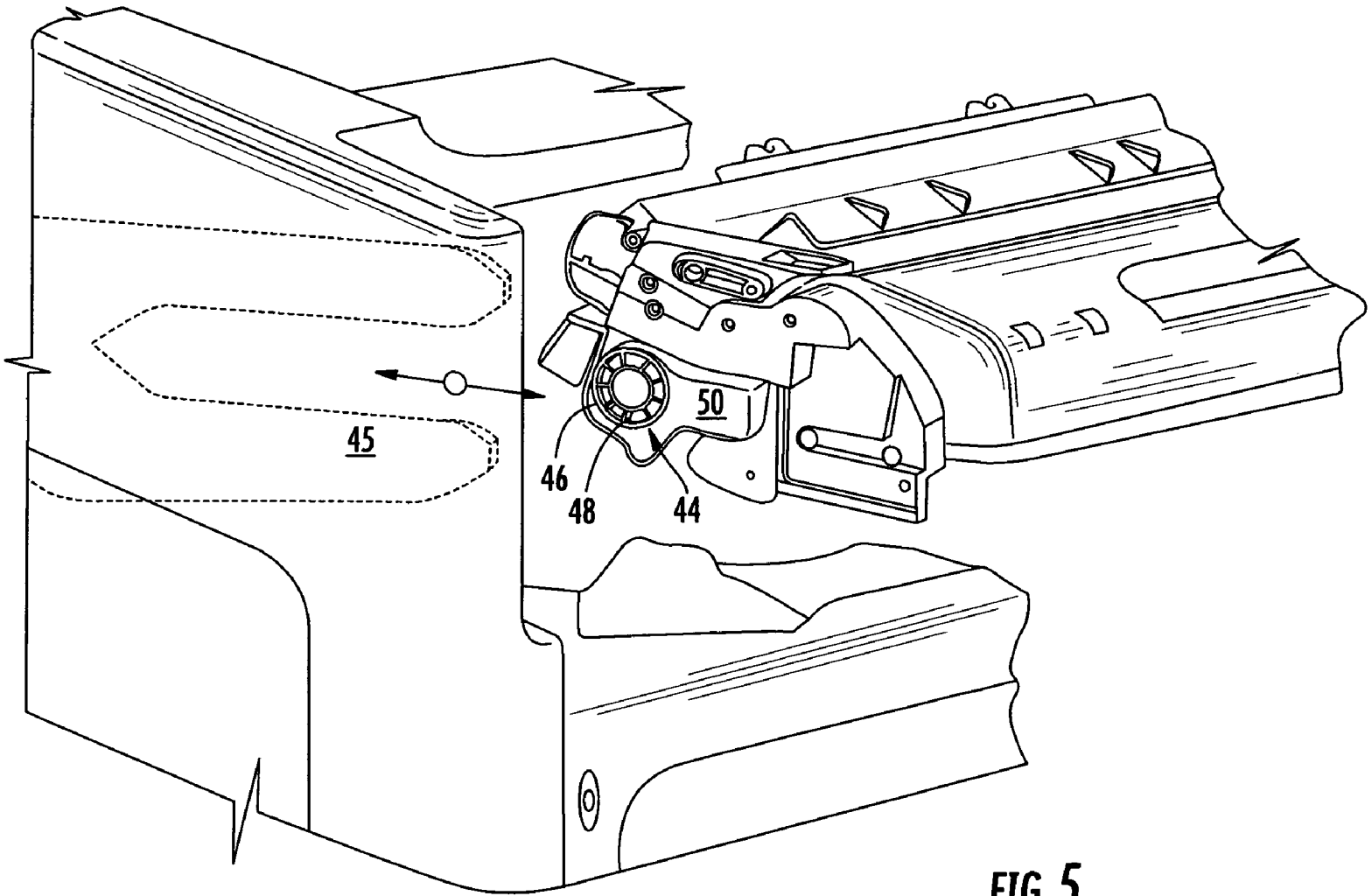
FIG. 5 (PRIOR ART)
FIG. 5 is substantially a perspective view of a portion of the printer housing showing the channel through which the drum bushing slides to place the printer cartridge at a predetermined position within the printer housing.

Referring now to FIG. 4, one side of the cartridge includes an engaging drum bushing 44. The engaging drum bushing 44 is configured to surround the drum axle 36 by its circular structure 46. The circular structure 46 includes a plurality of spokes 48 within it and which also surround the drum axle 36. The circular structure 46 is attached to an engaging bushing arm 50. The engaging drum bushing 44 is configured to fit through a drum bushing channel formed by the channel forming sidewalls 45 of a printer (FIG. 5), which serve as a mounting structure for holding the printer cartridge in a predetermined position within the printer housing.

Figure 6:
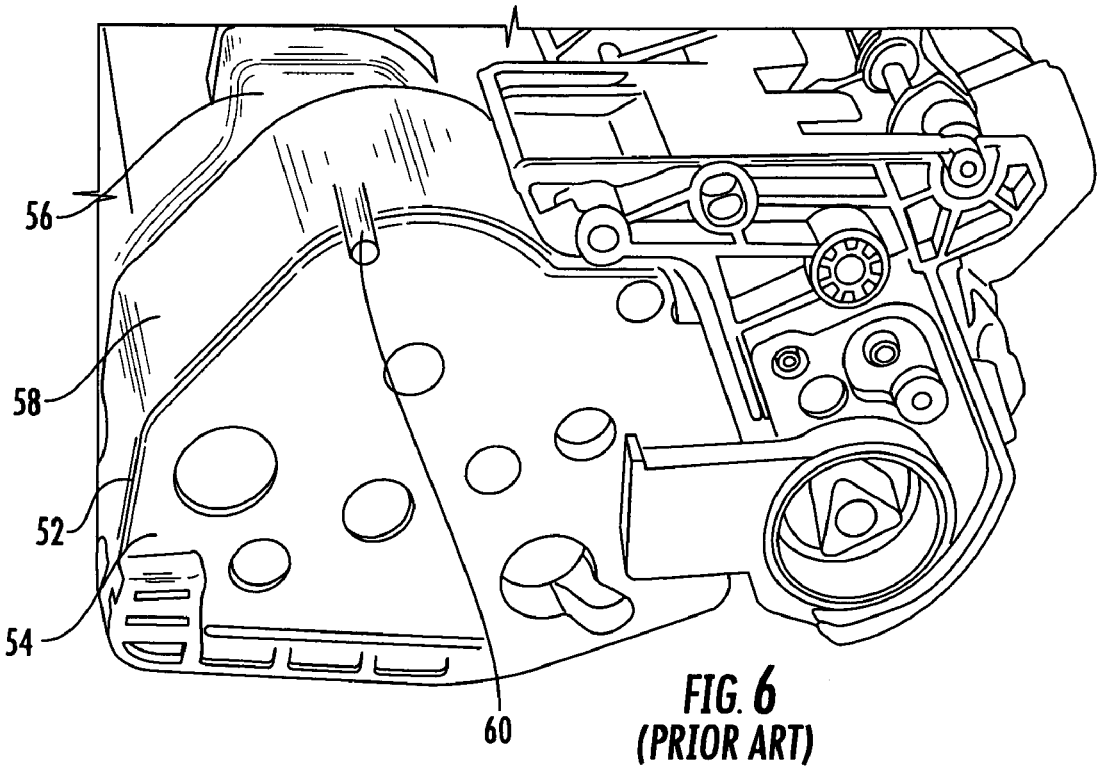
FIG. 6 (PRIOR ART)
FIG. 6 is substantially a front view of one side of the first printer cartridge showing the guide key that is attached to the end cap.

Referring now to FIG. 6, cartridges for HP1320 include end caps 52 positioned on each side. Each end cap includes a sidewall 54 that is substantially parallel to the sidewall of the toner hopper 56. Each end cap also includes a curved surface 58 that is positioned in between the end cap sidewall 54 and the toner hopper sidewall 56. One of the end caps includes an end cap guide key 60 attached to the curved surface 58.

Figure 7:
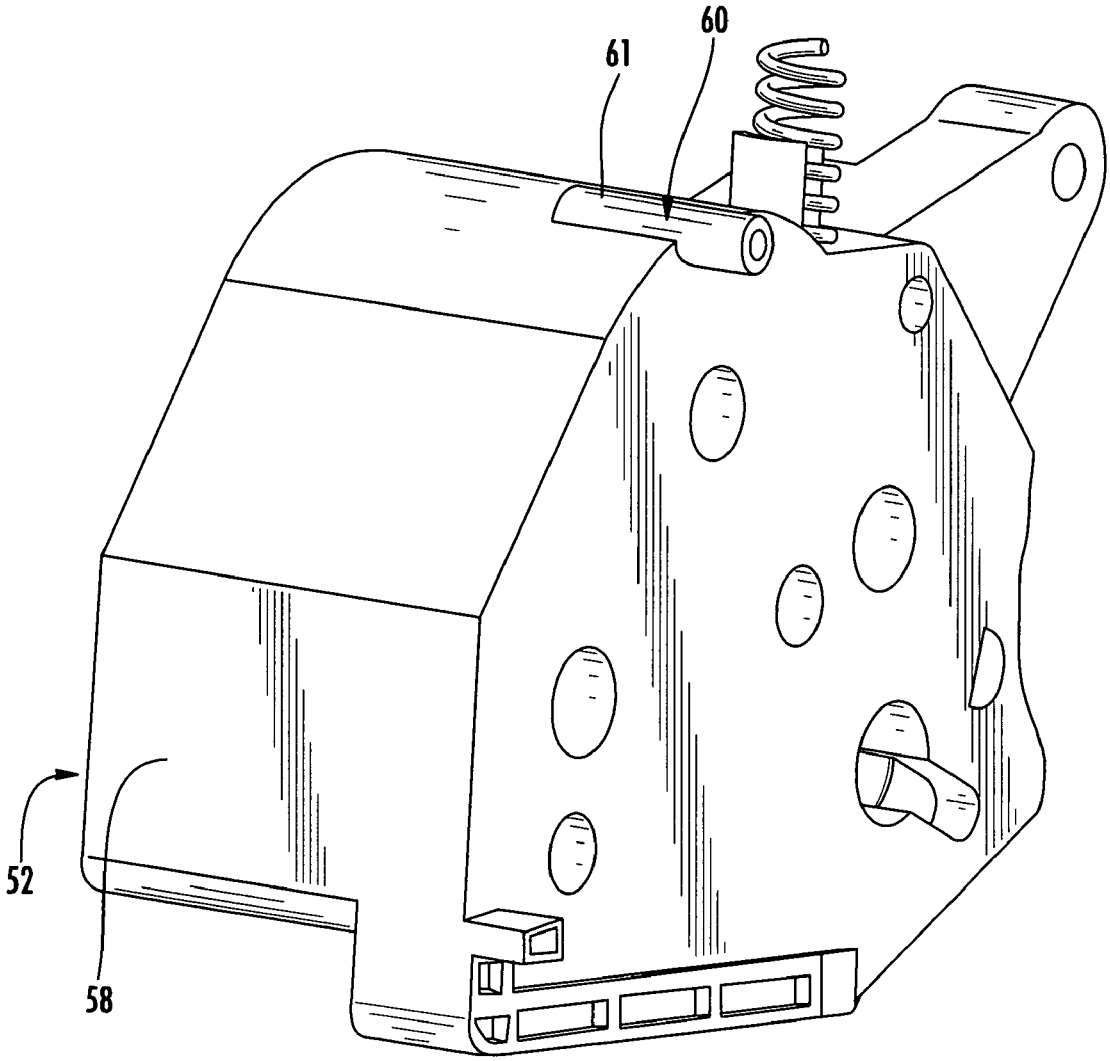
FIG. 7 (PRIOR ART)
FIG. 7 is substantially a perspective view of an end cap of the printer cartridge of FIG. 6.

Referring now to FIG. 7, the end cap guide key 60 includes a cylindrical body with a hollow interior positioned substantially horizontally relative to the top of the curved surface 58. The end cap guide key 60 is attached to the curved surface 58 in a manner wherein about half of the length of the end cap guide key 60 is partially buried within the end cap 52. About half of the cylindrical body is directly attached to the end cap 52 (hereinafter the "attached portion") while the remaining portion hangs from the end cap 52 (hereinafter the "hanging portion"). The attached portion 61 includes a height, and about half of the height of the attached portion 61 is embedded within the end cap 52. The remaining half of the height of the attached portion 61 protrudes from the surface of the end cap 52.

Printer Cartridges for HP2015 Printers

Figure 8:
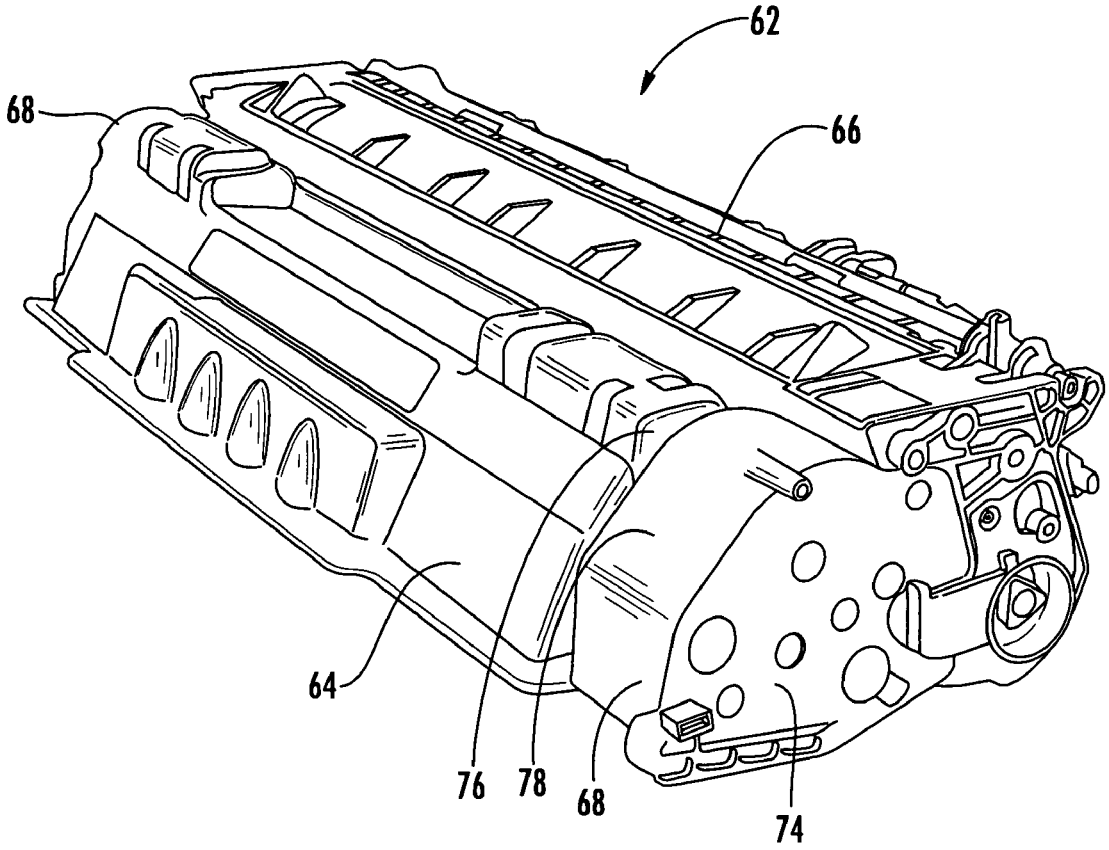
FIG. 8 (PRIOR ART)
FIG. 8 is substantially a perspective view of a third printer cartridge that is compatible with a third printer type.

Referring now to FIG. 8, printer cartridges 62 for the HP2015 printer include a toner hopper 64, waste hopper 66, and end caps 68 positioned on each of its sides. The end caps 68 are similar to the end caps 52 and include a sidewall 74, which is parallel to the toner hopper sidewall 76. The end caps 68 further include a curved surface 78 in between the end cap sidewall 74 and toner hopper sidewall 76.

Figure 9:
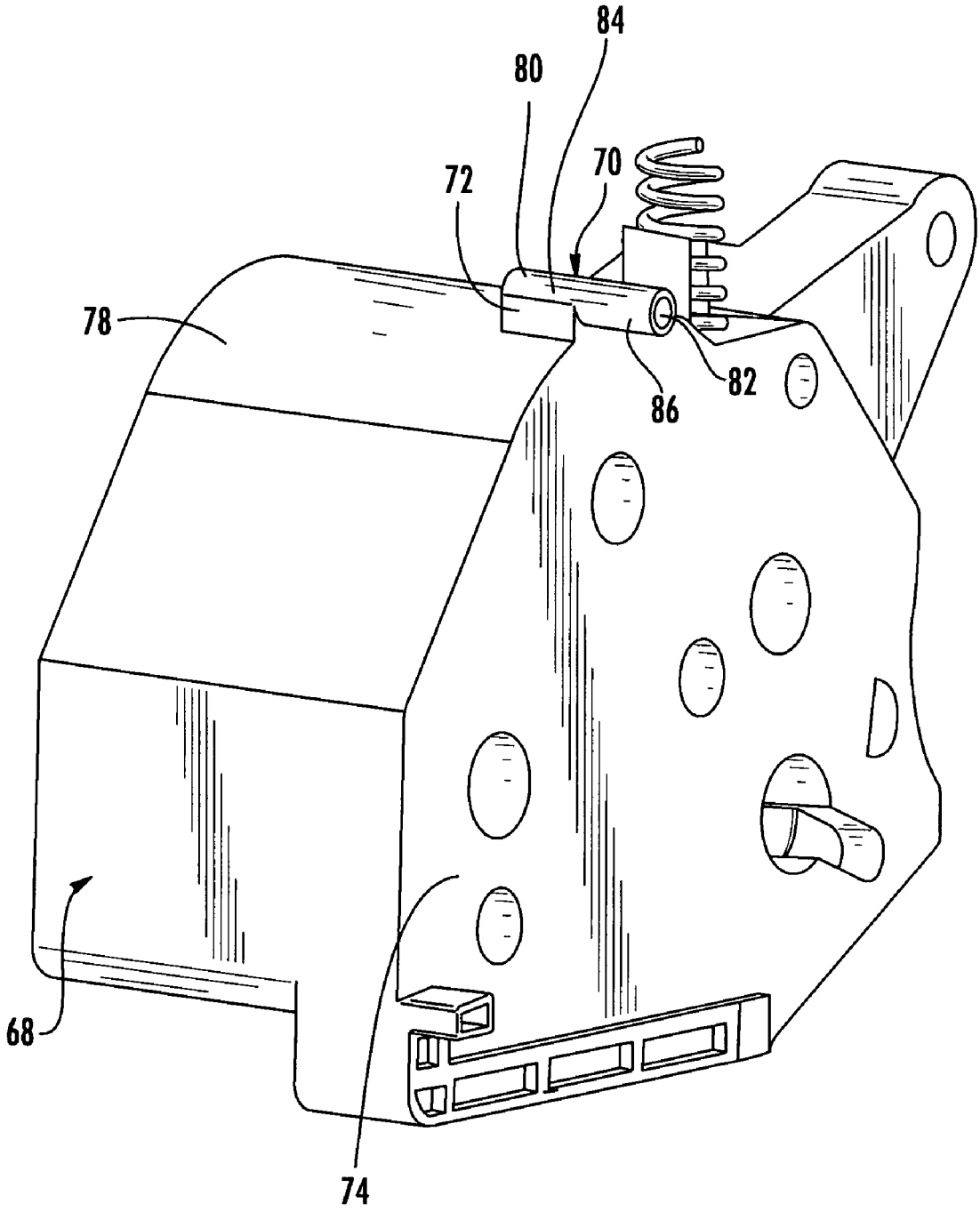
FIG. 9 (PRIOR ART)
FIG. 9 is substantially a perspective view of an end cap of the printer cartridge of FIG. 8.

Referring now to FIG. 9, one of the end caps 68 also includes a guide key 70 that is connected to the end cap curved surface 78 via a guide mount 72. The guide key 70 is raised from the end cap 68 by the guide mount 72, which is directly attached to the curved surface 78. The end cap guide key 70 includes a substantially cylindrical body 80 with a hollow interior 82 defined by the cylindrical body 80. A substantial first portion of the cylindrical body 84 is directly attached to the guide mount 72. The remaining second portion of the cylindrical body 86 of the end cap guide key 70 forms an overhang that extends from the sidewall of the end cap 74.

The applicant has discovered that the printer cartridge for the HP2015 (62) has significant similarities with the printer cartridge (32) for the HP1320. A few differences exist, and they include the designs of the guide keys attached to their respective end caps and the sizes of their drum axle bushings. The guide keys 80 for the HP2015 compatible printer cartridge 62 are mounted to the end caps 68 via a guide key mount 72, while the guide keys 60 for the HP1320 compatible printer cartridge 32 are mounted directly to the end caps 52 and are partially embedded therein.

As regards to the drum axle bushings, the printer cartridge (62) for the HP2015 include a drum axle bushing that has a smaller circular structure (not shown) than the circular structure 46 of the drum axle bushing 48 of the printer cartridge (32) for the HP1320. HP2015 compatible printer cartridge's corresponding arm that is connected to the circular structure of the drum axle bushing is also smaller than that of the HP1320 compatible printer cartridge.

Figure 10:
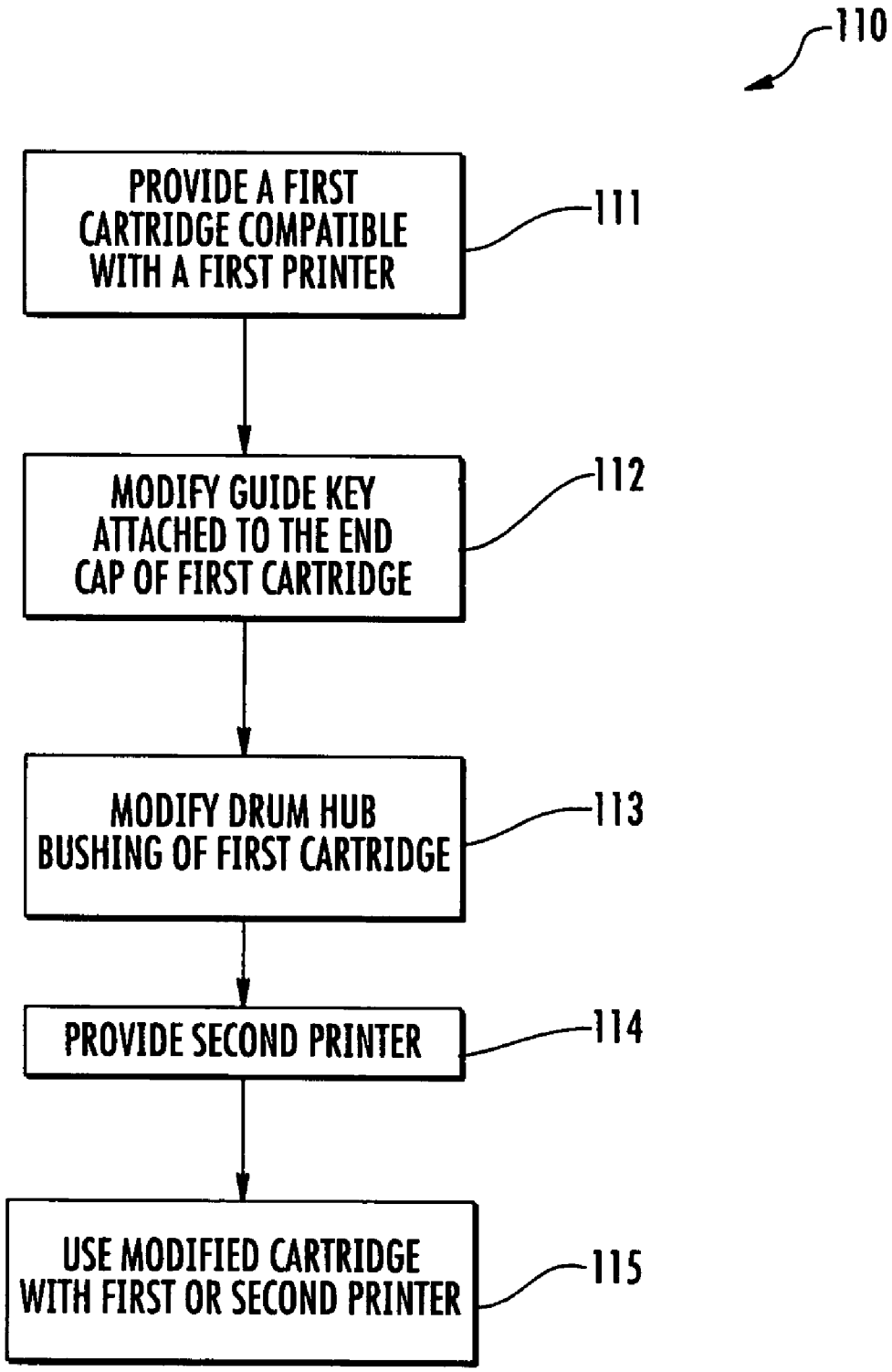
FIG. 10 is substantially a flowchart showing a second embodiment of the printer cartridge conversion method of the present invention.

Referring now to FIG. 10, the second embodiment (110) of the cartridge conversion method of the present invention includes providing a first cartridge that is compatible with a first printer type (step 111). In the example above, the first cartridge may be a cartridge that is compatible with HP1320 cartridge. The guide key that is attached on the end cap of the first cartridge may then be modified (step 112). For example, the guide key 80 may be cut to remove the overhang portion 86. Alternatively, a new end cap may also be provided without a guide key 80 or with a shortened guide key 80.

Next, the drum hub bushing of the first cartridge may be modified (step 113). For instance, the drum hub bushing of the first cartridge may be replaced with a smaller drum hub bushing. The replacement drum hub bushing may include a circular structure smaller than the circular structure 46 of the engaging drum hub bushing 44 of the HP1320 compatible cartridge. A second printer type may be provided (step 114), and the resulting modified cartridge may be used with the first or second printer types (step 115). In the example provided, the resulting modified cartridge, which may initially be an HP1320 compatible printer cartridge, may be used with the HP2015 printer. It is noted that with the present invention, the resulting modified cartridge may also be used with the first printer type. Thus, for example, the resulting modified cartridge may still be used with the HP1320 printer despite having a modified guide key and bushing.

Third Embodiment of the Printer Cartridge Conversion Method

The third embodiment of the printer cartridge conversion method is exemplified by the conversion of a cartridge for an HP1160 printer to a cartridge that may be used for an HP1320 printer, and the subsequent conversion of the cartridge for the HP1320 printer to a cartridge that may be used for an HP1320 printer, an HP2015 printer, or both.

The cartridge for an HP1160 printer may be converted to an HP1320 compatible cartridge by executing the steps of the first embodiment of the printer cartridge conversion method discussed above. The HP1320 compatible cartridge may subsequently be converted to an HP2015 compatible cartridge and HP1320 compatible cartridge by executing the steps of the second embodiment of the printer cartridge conversion method discussed above.

It can be realized that certain embodiments of the present invention provides methods for increasing the availability of printer cartridges that may be in short supply. Accordingly, certain embodiments of the present invention may allow remanufacturers of printer cartridges to save money from the cost of empties and increase their profitability. For example, an HP1160 printer cartridge may be converted to an HP1320 cartridge using the first embodiment of the present invention then to an HP2015 cartridge using the second embodiment of the present invention. Remanufacture of HP1320 and HP2015 cartridges is made possible by the present invention without having to rely on the presence of HP1320 or HP2015 empties.

Although the description above contains many specifications, these should not be construed as limiting the scope of the invention but as merely providing illustrations of some of the presently preferred embodiments of this invention. For example, the shapes and sizes of the modified end cap guide pins may be varied and still fall within the scope of the invention. The invention is capable of other embodiments and of being practiced and carried out in various ways. The invention is not limited in its application to the details of the construction and to the arrangement of the components set forth in the above description or as illustrated in the drawings.

What is claimed is:

1. A modified printer cartridge being initially a first printer cartridge configured to operate with a first printer, the first printer cartridge comprising a waste hopper configured to store excess toner during printing, a first toner hopper connected to the waste hopper, a drum positioned within the printer cartridge, the drum being attached to the printer cartridge by a drum axle, a first drum axle bushing configured to surround the drum axle, a first end cap attached to the first toner hopper, the first end cap comprising a sidewall, the first toner hopper comprising a sidewall in parallel position relative to the end cap sidewall, the first end cap further comprising an end cap surface positioned in between the first toner hopper sidewall and the end cap sidewall and a first guide key attached to the end cap surface, the modified printer cartridge comprising:

a. a modified toner hopper connected to the waste hopper, the modified toner hopper being configured to store toner for printing, the modified toner hopper being configured to replace the first toner hopper, the modified toner hopper having larger toner capacity than the first toner hopper, wherein the modified printer cartridge is configured to operate with a second printer, the second printer being distinct from the first printer.

2. The modified printer cartridge of claim 1, wherein the modified toner hopper is from a used cartridge.

3. The modified printer cartridge of claim 1, wherein the modified toner hopper is from an original equipment manufacturer.

4. The modified printer cartridge of claim 1, further comprising a modified drum axle bushing, the modified drum axle bushing being configured to replace the first drum axle bushing, the modified drum axle bushing having a smaller diameter than the first drum axle bushing.

5. The modified printer cartridge of claim 1, further comprising a modified guide key, the modified guide key being configured to replace the first guide key, the modified guide key having a shorter length than the first guide key.

6. The modified printer cartridge of claim 5, further comprising a replacement end cap, the replacement end cap being configured to replace the first end cap, the modified guide key being attached to the replacement end cap.

7. A method of modifying a printer cartridge, the printer cartridge being configured to be used with a first printer, the printer cartridge comprising a first toner hopper, a waste hopper connected to the first toner hopper, an end cap connected to the first toner hopper, and a guide key connected to the end cap, the printer cartridge further comprising a drum positioned within the printer cartridge, the drum being attached to the printer cartridge with a drum axle, the printer cartridge further comprising a bushing configured to surround the drum axle, the method comprising:

a. modifying the guide key;

b. modifying the bushing;

c. providing a second printer; and d. using the printer cartridge with the second printer.

8. The method of claim 7, wherein the end cap comprises a sidewall and the guide key comprises a guide key portion that protrudes from the sidewall, the step of modifying the guide key comprises cutting at least partially the guide key portion that protrudes from the sidewall.

9. The method of claim 7, wherein the step of modifying the guide key comprises shortening the guide key.

10. The method of claim 7, wherein the step of modifying the guide key comprises eliminating the guide key.

11. The method of claim 7, wherein the step of modifying the bushing comprises reducing the size of the bushing.

12. The method of claim 7, wherein the bushing comprises a circular structure surrounding the drum axle, the step of modifying the bushing comprising reducing the diameter of the circular structure.

13. The method of claim 7, wherein the bushing comprises a circular structure surrounding the drum axle and a bushing arm connected to the circular structure, the step of modifying the bushing comprising reducing the dimensions of the bushing arm.

14. The method of claim 7, further comprising using the printer cartridge with the first printer.

15. The method of claim 7, further comprising:

a. providing a second toner hopper, the second toner hopper being distinct from the first toner hopper;

b. replacing the first toner hopper with the second toner hopper; and c. using the printer cartridge with the second printer.

16. The method of claim 7, further comprising using the cartridge with a third printer, the third printer being distinct from the first printer and the second printer.

17. A method of modifying a printer cartridge, the printer cartridge being configured to be used with a first printer, the printer cartridge comprising a first toner hopper and a waste hopper connected to the toner hopper, the method comprising:

a. providing a second toner hopper, the second toner hopper being distinct from the first toner hopper;

b. replacing the first toner hopper with the second toner hopper;

c. providing a second printer; and d. using the printer cartridge with the second printer.

18. The method of claim 17, further comprising detaching a toner hopper from a used cartridge and using the toner hopper as a second toner hopper.

19. The method of claim 17, further comprising detaching a toner hopper from a printer cartridge that is not configured to be used with the first printer and using the toner hopper as the second toner hopper.

* * * * *